United States Patent [19]

Patel et al.

[11] Patent Number: 4,636,594

[45] Date of Patent: Jan. 13, 1987

[54] SWITCH WITH AUXILIARY BIASING MECHANISM

[75] Inventors: Janak R. Patel, Indian Head Park; John S. Schaffer, Tinley Park, both of Ill.

[73] Assignee: G & W Electric Company, Blue Island, Ill.

[21] Appl. No.: 779,564

[22] Filed: Sep. 24, 1985

[51] Int. Cl.[4] ..... H01H 21/54

[52] U.S. Cl. ..... 200/15; 200/17 R; 200/67 PK; 200/153 SC

[58] Field of Search ..... 200/17 R, 50 A, 15, 200/153 SC, 67 PK, 18

[56] References Cited

U.S. PATENT DOCUMENTS

| | | | |
|---|---|---|---|
| 1,440,467 | 1/1923 | Jennings | 200/67 A |
| 1,588,359 | 6/1926 | Hammann | 200/67 A |
| 1,768,885 | 7/1930 | Burrows | 335/15 |
| 2,754,688 | 7/1956 | Barecki | 74/100 |
| 2,761,029 | 8/1956 | Peabody | 200/67 R |
| 3,403,565 | 10/1968 | Kovats | 74/97 |
| 3,577,887 | 5/1971 | Lambert et al. | 200/153 SC |
| 3,582,595 | 6/1971 | Stene | 200/153 FC |
| 4,467,161 | 8/1984 | Fox et al. | 200/281 |

FOREIGN PATENT DOCUMENTS

| | | |
|---|---|---|
| 404784 | 5/1924 | Fed. Rep. of Germany . |
| 2909458 | 10/1980 | Fed. Rep. of Germany . |

*Primary Examiner*—A. D. Pellinen
*Assistant Examiner*—Morris Ginsburg
*Attorney, Agent, or Firm*—Fitch, Even, Tabin & Flannery

[57] ABSTRACT

An electric power distribution switch including an auxiliary biasing mechanism to assist the operator in closing the switch to overcome the resultant repulsive forces which oppose the closing forces provided by the operator.

6 Claims, 5 Drawing Figures

SWITCH WITH AUXILIARY BIASING MECHANISM

BACKGROUND OF THE INVENTION

The invention relates to an electric power distribution switch and an auxiliary biasing mechanism therefor. One type of electric power distribution switch includes one or two sets of three stationary, fixed contacts and a rocker arm assembly which includes a set of three movable contacts mounted on a rocker arm. The rocker arm assembly rotates to make and break contact between the movable contacts and the fixed contacts. A spring-loaded operator rotates the rocker arm assembly to provide snap-action opening and closing of the switch in response to manual rotation of a handle. An example of a switch of this type which has proven successful in commercial use is described in commonly assigned U.S. Pat. No. 4,467,161, which is incorporated herein by reference. An operator for this type of switch is described in commonly assigned U.S. Pat. No. 3,403,565, which is also incorporated herein by reference.

When an electric current flows through a set of movable contacts in close proximity to or in contact with a set of fixed contacts, electrically generated repulsive forces, sometimes known as "blow-out" forces, urge the respective sets of contacts apart. Such forces are proportional to the square of the current flowing through the contacts. The forces are relatively low for normal current conditions, but become significant when the switch is being closed into a fault condition. When the switch is closed into a fault, arcing between the contacts may commence when the contacts are a small distance apart, and the resultant repulsive forces oppose the closing forces provided by the operator. The ability of the switch to close into a fault may be limited by the magnitude of the repulsive forces which can be overcome when closing the switch. An object of the invention is to provide an electric power distribution switch having increased capacity to overcome such repulsive forces.

SUMMARY OF THE INVENTION

In accordance with the present invention, auxiliary biasing means augment the closing force provided by the operator to increase the velocity of the movable contacts as they approach a set of fixed contacts, thus increasing the ability of the switch to overcome repulsive forces between the contacts during closing. The invention may additionally serve to decelerate the movable contacts during opening of the switch to reduce impact loading on switch components. During opening potential energy is transferred from the operator to the auxiliary biasing means. A portion of the kinetic energy of the rocker arm may also by converted into potential energy in the auxiliary biasing means. This potential energy is stored while the switch remains in open position and released during closing to increase the kinetic energy of the rocker arm assembly and movable contacts.

DETAILED DESCRIPTION OF THE PREFERRED EMBODIMENT

Figure 1:
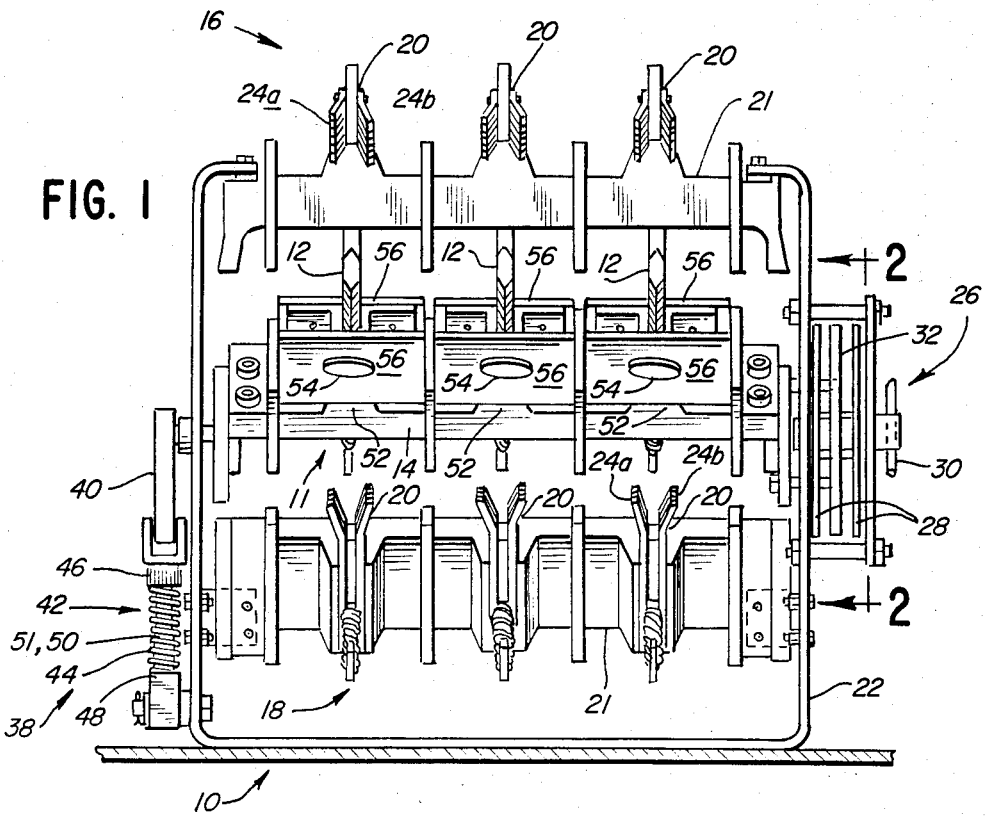
FIG. 1 is a front view of a switch in accordance with the invention, shown in open position.
Figure 2:
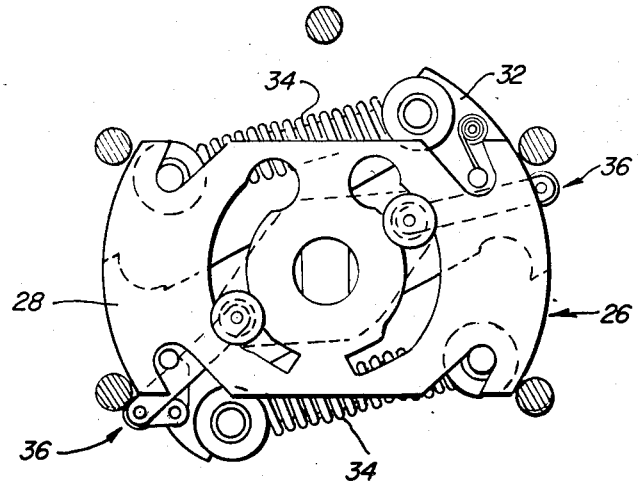
FIG. 2 is a view of the operator of the switch of FIG. 1, taken substantially along line 2—2 in FIG. 1 and looking in the direction of the arrows.
Figure 3:
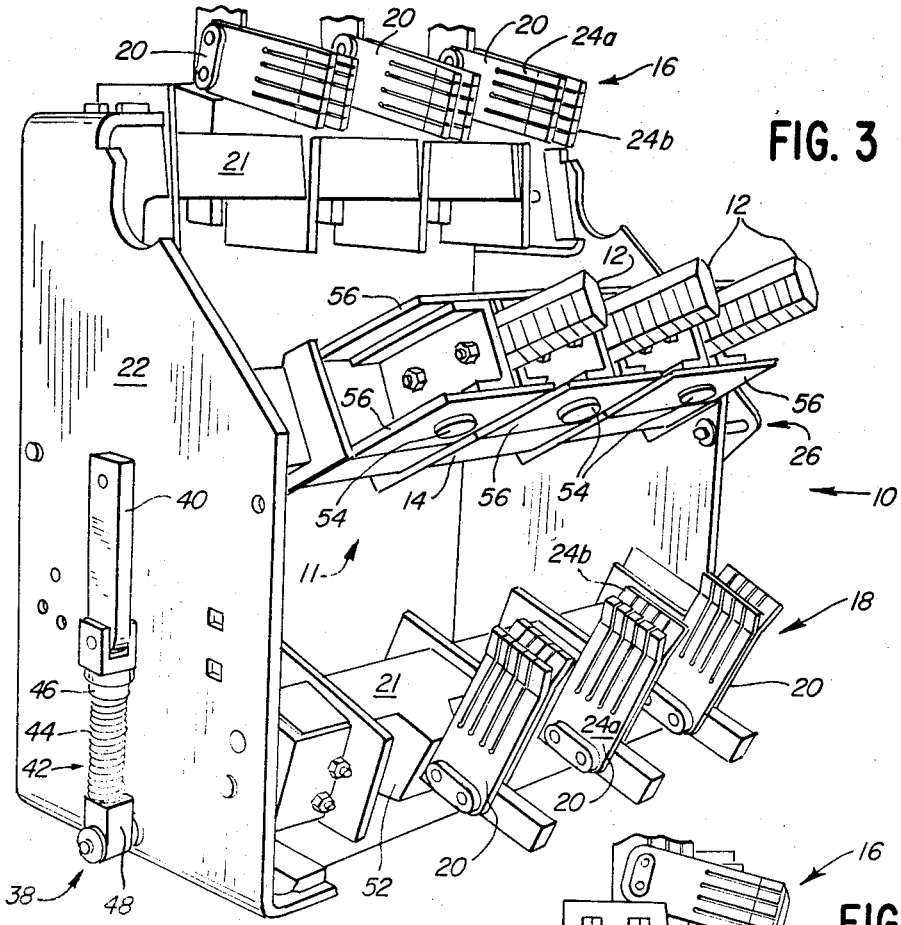
FIG. 3 is a perspective view of the switch of FIG. 1, shown in open position.

The invention is generally embodied in an electric power distribution switch 10 which includes a rocker arm assembly 11 comprising a set of three movable contacts or blades 12 mounted on a rotating rocker arm 14 supported by a frame 22. Two sets 16, 18 of stationary contacts 20 are fixedly supported on stationary arms 21 for engagement by the movable contact blades 12 on the rocker arm 14. The stationary arms are attached at both ends to the frame 22. Each of the fixed contacts includes a pair of resilient members **24*a*, 24*b* biased toward each other so as to grip the blade 12 when the blade 12 is inserted therebetween. The rocker arm 14 is rotatable between two closed positions located about 120° apart, in each of which the movable contact blades 12 engage a respective set of the fixed contacts 20, and an open position located between the closed positions. In a typical switch, the components described above and illustrated in FIG. 1** are disposed within a sealed housing containing a dielectric fluid such as oil or sulfur hexafluoride.

Rotation of the rocker arm 14 to open and close the switch is effected by an operator 26 which is mounted on the frame 22. The operator 26, as described in above-referenced U.S. Pat. No. 3,403,565, includes a pair of torque plates 28 which are connected directly to a handle 30 and connected indirectly to an actuator plate 32 by a pair of coil springs 34. The actuator plate 32 is fixed to the rocker arm 14. To open or close the switch 10, the handle 30 is manually rotated through a stroke of about 60°, which effects similar rotation of the torque plates 28. Through most of the stroke of the handle 30, the actuator plate 32 is constrained by a hold and release mechanism 36 so that the coil springs 34 are compressed and the rocker arm 14 remains stationary. When the springs 34 are fully compressed, the bperator 26 is fully cocked. At this point, near the end of the stroke of the handle, the actuator plate 32 is released, which enables the rocker arm assembly 11 to be driven in snap-action rotation by the springs 34 to the desired position. Once the rocker arm assembly 11 reaches the desired position, the hold and release mechanisms 36 latch the rocker arm assembly 11 in place.

In accordance with the present invention, the power distribution switch includes an auxiliary biasing mechanism 38 which augments the energy transferred to the rocker arm assembly 11 from the operator 26 during closing of the switch 10 to aid in overcoming repulsive forces between the contacts. In addition to assisting the operator 26 in closing the switch 10, the auxiliary biasing mechanism 38 increases switch life by reducing the transfer of potential energy from the operator into kinetic energy of the rocker arm; thereby, reducing mechanical impact forces upon opening. The auxiliary biasing mechanism 38 of the invention absorbs a portion of the operator's potential energy and may convert a portion of the kinetic energy of the rocker arm assembly 11 into potential energy which is stored in the auxiliary biasing mechanism. During the closing operation the stored potential energy is transferred back to the rocker arm assembly 11 to increase the velocity, and thus the kinetic energy, thereof. This addition of kinetic energy increases the capacity of the switch 10 in that the switch is capable of closing into a circuit of higher current than previously made switches of this type.

In the preferred embodiment of the invention, the auxiliary biasing mechanism 38 comprises a crank arm 40 fixed to the rocker arm 14 and extending radially outward therefrom, and a spring assembly 42 which is pivoted at one end to the crank arm 40 and pivoted to the frame 22 at its opposite end. The spring assembly 42 comprises a linear coil spring 44 which is loaded in compression. The spring 44 is aligned with the crank arm 40 at maximum compression when the switch 10 is in open position. This maximizes the potential energy of the auxiliary biasing mechanism 38 when the switch 10 is in open position, and provides equivalent operational benefits with regard to either closed contact position. It has an additional benefit in that because of the alignment of the crank arm 40 and spring assembly 42, the torque on the rocker arm 14 in open position is substantially zero. This prevents the auxiliary biasing mechanism 38 from loading the hold and release mechanism 36 when the switch 10 is in open position.

Figure 5:
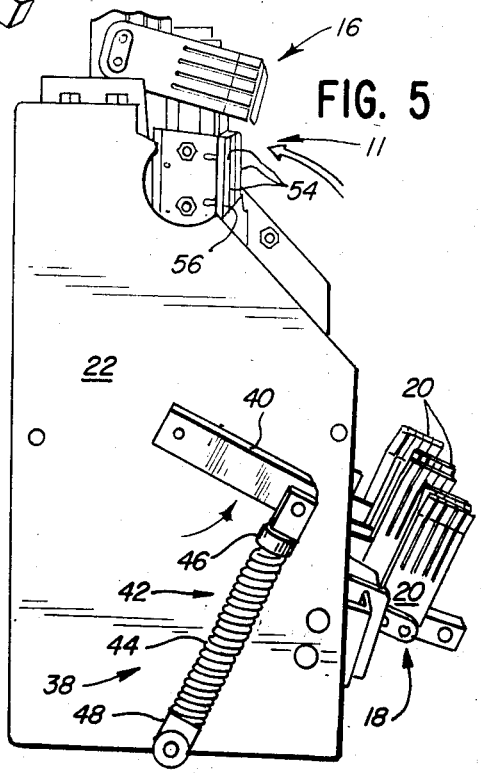
FIG. 5 is a perspective view of the switch of FIG. 1, taken from one side of the switch, with the switch shown in a closed position.

The illustrated spring 44 is compressed between an upper clevis 46 which is pivotally connected to the crank arm 40, and a lower clevis 48 at the opposite end which is pivotally connected to the frame 22 of the switch 10. A telescoping rod 50 and guide 51 (FIG. 1) extend down the center of the spring 44 to prevent buckling. As illustrated in FIG. 5, when the switch 10 is in a closed position, the crank arm 40 and spring 44 intersect at an obtuse angle and the spring 44 is less compressed than when the switch 10 is in open position. Thus, the potential energy of the spring 44 is lower in either of the closed positions than in the open position.

Figure 4:
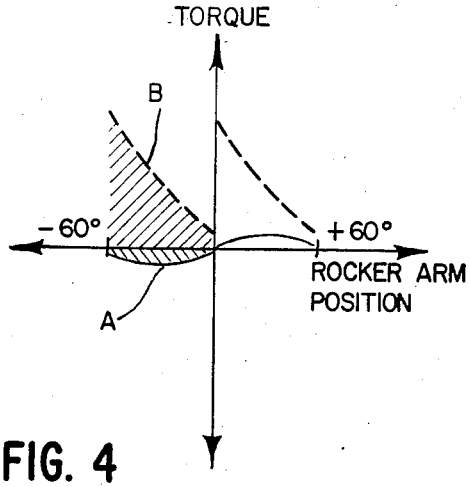
FIG. 4 is a diagram illustrating torque applied by the operator and the auxiliary biasing mechanism as a function of rocker arm position. The torque applied by the operator is indicated by a broken line, and that applied by the auxiliary biasing mechanism is shown as a solid line.

When the switch 10 is in open position and being shifted to closed position, the operator 26 exerts relatively high torque on the rocker arm assembly 11 at the beginning of the stroke. As the springs 34 in the operator 26 relax, the torque exerted by the operator 26 decreases. The torque provided by the auxiliary biasing mechanism 38 increases at the beginning of the stroke from open to closed position, peaks, and then decreases near the end of the stroke. In FIG. 4 the torque provided by the operator 26 is shown as a broken line and the torque provided by the auxiliary biasing mechanism 38 is shown as a solid line. The closing stroke is shown on the right hand side of the vertical axis, with 0° representing the open position and +60° representing either closed position.

The auxiliary biasing mechanism 38 and the operator 26 provide torque in the same direction during closing of the switch 10. During normal switching conditions, repulsive forces are relatively low, and this torque is opposed primarily by frictional forces, and drag such as that resulting from movement of the blades 12 through the dieletric fluid until the blades 12 reach the fixed contacts 20.

Turning to a consideration of opening of the switch 10, if the switch is not equipped with the auxiliary biasing mechanism of the invention, but instead were equipped with a more powerful operator, the rocker arm assembly 11 would be decelerated solely by the hold and release mechanism 36 of the operator 26 upon reaching open position. This would result in transmittal of relatively high impact loads to the hold and release mechanism 36, and additionally would also result in relatively high impact loads on the rocker arm assembly 11. Because the decelerating torque would act only on one end of the rocker arm 14, torsional loading of the rocker arm 14 would be relatively high. Bending stresses on the blade supports 52 would also be high due to the radial projection of the blades 12. Accordingly, although adequate closing force could be provided simply by increasing the energy storage of the springs 34 in the operator 26, such an increase would amplify impact loads on opening and probably reduce switch life without the auxiliary biasing mechanism 38.

The auxiliary biasing mechanism 38 of the invention reduces impact loading on the hold and release mechanism 36 during opening of the switch 10 by maintaining a reduced kinetic energy level of the rocker arm assembly 11 as it approaches the open position. The auxiliary biasing mechanism 38 also increases the impact loading as the switch closes by increasing the kinetic energy of the rocker arm assembly 11 during closing. However, this is acceptable because when closing, the rocker arm assembly 11 is not decelerated solely by the hold and release mechanism 36 of the operator 26. Rather, the frictional engagement of the blades 12 by the fixed contacts 20 absorbs energy providing decelerating torque, and the switch 10 may also include bumpers 54 for providing additional energy absorption. The frictional forces on the blades 12 act tangentially with respect to the rocker arm 14, thereby reducing the aforementioned bending stresses on the blade supports 52. Furthermore, because the frictional forces act at spaced locations along the length of the rocker arm assembly 11, torsional loading of the rocker arm 14 is reduced as compared with that occurring during the opening stroke. The frictional engagement of the blades 12 by the fixed contacts 20 additionally helps to damp vibrations occurring at the end of the closing stroke.

The bumpers 54 in the illustrated embodiment are mounted on flaps 56 attached to the blades 12 so that decelerating forces act on the blades 12 directly through the bumpers 54, rather than through the rocker arm 14. This substantially reduces the stress on the rocker arm 14 as compared to the stress which occurs when the operator 26 alone decelerates the rocker arm 14. The bumpers 54 strike the fixed contact support arm 21 at a predetermined point in the rocker arm stroke such that the hold and release mechanism 36 provides lesser decelerating force at the end of the stroke.

With regard to increasing the ability of the switch 10 to close into a fault, the most important function of the auxiliary biasing mechanism 38 is not to increase the torque on the rocker arm 14 at the end of the stroke, but rather to increase the kinetic energy of the rocker arm assembly 11. What is determinative of the ability of the switch to close into a fault is whether the kinetic energy of the rocker arm assembly 11 at the point at which arcing commences exceeds the integral over the remainder of the stroke of the sum of the torque exerted by repulsive forces between the contacts 12 and 20 and the frictional forces opposing the closing of the switch 10, assuming the potential energy changes in the operator 26 and auxiliary biasing mechanism 38 to be negligible for this portion of the stroke.

In switching from a closed position to the open position, the auxiliary biasing mechanism 38 opposes the operator 26. Accordingly, in order for the operator 26 to be capable of switching the switch 10 from closed to open position, the operator 26 must provide greater torque on the rocker arm assembly 11 than the auxiliary biasing mechanism 38 at the beginning of the stroke. Accordingly, the spring 44 in the auxiliary biasing mechanism 38 is relatively relaxed when the switch 10 is in closed position, so that the force exerted by the spring 44 is relatively low. As the rocker arm assembly 11 begins to shift from closed to open position, the spring 44 is compressed, and applies increasing force to the end of the crank arm 40 which results in application of increasing torque to the rocker arm assembly 11. This torque subsides as the open position is approached. The relationship of the torque applied by the auxiliary biasing mechanism 38 and the torque applied by the operator 26 as a function of rocker arm position during opening of the switch is illustrated on the left-hand portion of FIG. 4. A closed position of the switch is represented at −60° on the horizontal axis, and the open position is represented at 0°.

The resultant torque applied to the rocker arm for opening the switch is the sum of the positive operator torque and negative auxiliary biasing mechanism torque from FIG. 4. The resultant opening torque may always be positive or for certain spring combinations may, for a set period in time, be negative. For the case where the torque applied by the auxiliary biasing mechanism temporarily exceeds that applied by the operator, the resultant torque is negative and the rocker arm is decelerated by the auxiliary biasing mechanism. As the rocker arm assembly 11 approaches the open position, the angle between the crank arm 40 and spring 44 approaches 180°, decreasing the effective moment arm through which the spring 44 applies torque to the rocker arm 14. This reduces the torque on the rocker arm 14 even though the spring force is increasing. At the end of the stroke, the crank arm 40 and spring 44 are substantially aligned in a vertical position, and substantially no torque is applied by the auxiliary biasing mechanism 38.

Although the torque applied by the auxiliary biasing mechanism 38 may exceed the torque applied by the operator 26 for a portion of the stroke of the rocker arm 14, it will be appreciated that in order for the operator 26 to open the switch 10, the potential energy released by the operator 26 must exceed that absorbed or stored by the auxiliary biasing mechanism 38 during opening of the switch 10. Thus, the integral of the torque applied by the operator 26 over the 60° rotation of the rocker arm 14 must be greater than the integral of the torque applied by the auxiliary biasing mechanism 38 over the length of the stroke. Referring to FIG. 4, this relationship requires that the area between the solid curve representing the torque applied by the auxiliary biasing mechanism 38 and the horizontal axis on the left side of the vertical axis (shaded area A) be less than the area between the broken curve representing the torque applied by the operator 26 and the horizontal axis (shaded area B) on the left side of the vertical axis. Furthermore, the difference between the potential energy released by the operator 26 (represented by area B) and that stored by the auxiliary biasing mechanism 38 (represented by area A) must be greater than the energy losses associated with the friction and drag of operation, and sufficient to maintain required travel velocities.

One advantage of the illustrated embodiment of the invention is provided by mounting of the auxiliary biasing mechanism 38 and operator 26 at opposite ends of the rocker arm 14. As explained in detail above, when shifting the switch 10 from open to closed position, the auxiliary biasing mechanism 38 and operator 26 apply torque in the same direction to the rocker arm 14. Location of the operator 26 and auxiliary biasing mechanism 38 at opposite ends of the rocker arm 14 helps to balance the torque thereon, which results in lower torsional stresses on the rocker arm assembly 38 during closing of the switch 10, as compared with a switch having the operator and the auxiliary biasing mechanism at the same end of the rocker arm.

A further advantage of the embodiment described hereinabove is that it may be manufactured essentially by adding the auxiliary biasing mechanism 38 to a proven switch having a history of success in the industry. The addition of the auxiliary biasing mechanism 38 increases the capacity of the switch by increasing the magnitude of current in a fault into which the switch may be closed, and additionally increases the life of the switch by reducing the impact forces associated with opening the switch.

While a preferred embodiment of the invention is illustrated and described hereinabove, there is no intent to limit the invention to this or any particular embodiment. The illustrated switch and the torque curves of FIG. 4 are shown for exemplary purposes only. The scope of the invention is defined by the language and spirit of the following claims.

What is claimed is:

1. An electric power distribution switch having at least one closed position and at least one open position, comprising:

a frame including a pair of side walls;

a rocker arm supported by said side walls and rotatable between a first predetermined position, corresponding to an open position of said switch and a second predetermined position corresponding to a first closed position of said switch;

a plurality of movable contacts fixed on said rocker arm for rotation therewith;

a first set of fixed contacts for engaging said movable contacts in said first closed position;

an operator connected to said rocker arm comprising spring means for storing potential energy, and manually rotatable input means for effecting discharge of said potential energy by application of torque to said rocker arm to effect rotation thereof; and auxiliary biasing means connected to said rocker arm and cooperative with said operator to assist said operator in rotating said rocker arm from said first predetermined position to said second predetermined position to shift said switch from open to closed position, and oppose said operator in rotating said rocker arm from said second predetermined position to said first predetermined position to shift said switch from closed to open position, said auxiliary biasing means being effective to apply torque to said rocker arm, said torque applied by said auxiliary biasing means being variable as a function of rocker arm position, said operator being capable of applying torque greater in magnitude than and opposite in direction to that applied by said auxiliary biasing means when said rocker arm is in said second predetermined position.

2. An electric power distribution switch in aqcordance with claim 1 wherein said auxiliary biasing means reduces available energy of said rocker arm when said rocker arm shifts from said second predetermined position to said first predetermined position.

3. An electric power distribution switch in accordance with claim 2 wherein said switch further comprises a second set of fixed contacts, and said switch has a second closed position, said rocker arm being rotatable to a third predetermined position, said third predetermined position corresponding to said second closed position of said switch, said first predetermined position of said rocker arm being between said second and third positions of said rocker arm, and wherein said auxiliary biasing means applies substantially no torque to said rocker arm when said rocker arm is in said first predetermined position.

4. An electric power distribution switch in accordance with claim 1 wherein said auxiliary biasing means comprises a crank arm extending from said rocker arm and a coil spring assembly having a first end pivotally connected to said frame and a second end pivotally connected to said crank arm, said crank arm being oriented so that said coil spring assembly biases said rocker arm toward said second predetermined position.

5. An electric power distribution switch in accordance with claim 1 wherein said operator and said auxiliary biasing means are connected to opposite ends of said rocker arm.

6. A switch comprising:

a frame including a pair of side walls;

a rocker arm rotatably supported by said side walls;

a plurality of movable contacts fixed on said rocker arm for rotation therewith;

a first set of fixed contacts which engage said movable contacts when said rocker arm is in a first closed position;

a second set of fixed contacts which engage said movable contacts when said rocker arm is in a second closed position;

an operator for rotating said rocker arm and providing mechanical equilibrium for said rocker arm at said first and second closed positions and at an open position between said first and second closed positions in which said movable contacts are spaced from both sets of fixed contacts, said operator including energy storage means capable of storing potential energy, a manually rotatable handle for movement in a predetermined stroke, said handle being connected to said energy storage means so that rotation of said handle through said stroke increases the potential energy in said energy storage means by a first predetermined quantity, and means for releasing said first predetermined quantity of potential energy at the end of said stroke to rotationally accelerate said rocker arm; and auxiliary biasing means comprising a coil spring for storing potential energy and a crank arm fixed to said rocker arm and projecting radially outward therefrom, said spring having one end pivotally mounted on said frame and an opposite end pivotally connected to said crank arm so that rotation of said rocker arm between said open position and either of said closed positions changes the potential energy of said spring by a second predetermined quantity;

said first predetermined quantity of potential energy being greater than said second predetermined quantity.

* * * * *